US005964669A

United States Patent [19]

Bloomer

[11] Patent Number: 5,964,669

[45] Date of Patent: Oct. 12, 1999

[54] PERFORMANCE ENHANCED GOLFING PUTTER

[76] Inventor: William Bloomer, 42110 8th St. East, Lancaster, Calif. 93535

[21] Appl. No.: 09/050,161

[22] Filed: Mar. 30, 1998

Related U.S. Application Data

[60] Provisional application No. 60/065,598, Nov. 18, 1997.

[51] Int. Cl.[6] ..... A63B 53/04

[52] U.S. Cl. ..... 473/250; 473/341; 273/DIG. 14

[58] Field of Search ..... 473/335, 340, 473/341, 349, 250, 251; 273/DIG. 14

[56] References Cited

U.S. PATENT DOCUMENTS

D. 246,475 11/1977 Denman .
2,121,295 6/1938 Jennings .
3,226,120 12/1965 Borah .
3,866,922 2/1975 Marci .
3,873,094 3/1975 Sebo et al. .
4,222,566 9/1980 Berry .
4,324,404 4/1982 Dian .
5,553,858 9/1996 McKoon et al. .

*Primary Examiner*—Sebastiano Passaniti
*Attorney, Agent, or Firm*—Roger A. Marrs

[57] ABSTRACT

A golf club head having weighted alignment members separated by a window to permit the golfer to visually observe a target beneath the head whereby the ball striking face of the head may be aligned with the golf ball preparatory for striking and ball travel along an intended path to a receiving cup. The alignment members may be solid metal blocks or solid metal rods and, in addition to assisting the golfer in alignment and sighting of the golf club head, serves a counterweight to balance the club as it is swung by the golfer during a stroke.

9 Claims, 1 Drawing Sheet

PERFORMANCE ENHANCED GOLFING PUTTER

This application claims priority from Provisional Application number 60/065,598 filed Nov. 18, 1997.

BACKGROUND OF THE INVENTION

1. Field of the Invention

The present invention relates to the field of golf, and more particularly to a golf club head which is weighted and which includes means for aligning the face of the club with a target.

2. Brief Description of the Prior Art

In the past, it has been the conventional practice to visually align the face of a golf club head with a target such as the back of a golf ball intended to be driven into a receiving cup. In the aligning procedure, the golfer generally attempts to maintain the face of the golf club head perpendicular to the direction or path over which the ball is intended to travel to the target. Sometimes, an ancillary or intermediate target is employed, such as a blade of grass or a spot on the green directly in front of the ball. In some instances, the blade of grass or the spot on the green is focused upon by the golfer located directly behind the ball.

Attempts have been made to assist the golfer in aiming the travel of the golf ball by providing holes or other alignment means within the golf club head so that the line of sight can be focused upon by the golfer with accuracy. However, the employment of sight openings is not permitted by the golfing association and therefore, the provision of such openings is not a practical solution. Also, by providing mechanical or optical sighting devices, the weight of the golf club head is rendered uneven and out of balance causing the club head to twist during the golfer's stroke.

Therefore, a long-standing need has existed to provide a novel means for assisting the focus of a golfer on the direction of travel of the golf ball as it is struck by a golf club head. Also, the means must be carried on the club head so as to provide proper balance during the golfer's stroke in order to eliminate or reduce twist of the head. Weight and balance are of import in order to maintain the striking face of the club head perpendicular to the direction of ball travel.

SUMMARY OF THE INVENTION

Accordingly, the above problems and difficulties are avoided by the present invention which provides a novel golf club head which enhances performance by providing guide means within the club head that may be seen by the golfer and which will assist the golfer in aligning the face of the head so that it is perpendicular to the intended line of ball travel. The guide means provides and serves as counterweights so as to balance the club head to prevent it from twisting during the golfer's stroke. In one form of the invention, the guide means for aligning the face of the club head perpendicular to the intended travel of the ball as well as the counterweights are embedded within a clear plastic material such that the golfer may see the guide means through the material of the club head and align the guide means properly. The guide means may take the form of elongated polished blocks or rods and are visible through the clear plastic material of the golf club head and the guide means are disposed parallel with respect to one another in fixed spaced-apart relationship so as to provide a sighting means. The ends of the guide means are perpendicular to the face of the putter head and the guide means or the sighting means are used for alignment purposes and to balance the putter head since the guide means serve as counterweights.

Therefore, it is among the primary objects of the present invention to provide a novel golf club having a head composed of transparent material that reveals alignment means carried interiorly of the material whereby the alignment means is in the sight of the golfer for aligning the face of the club head with the intended travel of the golf ball.

Another object of the present invention is to provide a novel visual alignment means for applying a counterweight to a golf club head in order to provide balance which will avoid twisting of the club head as it is swung by the golfer.

Another object of the present invention is to provide a novel golf head for a golf club having a clear plastic material embedded with parallel rods visible by the golfer and to be used for alignment purposes so that the golf ball is struck in a fashion to follow an intended course or target.

Still a further object of the present invention is to provide the golfer with the ability to focus on a spot on the green or a blade of grass directly behind the ball in order to strike the ball and cause it to follow an intended course towards a target.

An additional feature resides in fabricating a translucent golf putter body or head employing surface treatments to obtain a desired degree of reflectivity or transmissivity of incident light.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 4A is a front elevational view of a conventional putter and FIG. 4B incorporates the alignment and counterweight means of the present invention; and.

DESCRIPTION OF THE PREFERRED EMBODIMENT

Figure 1:
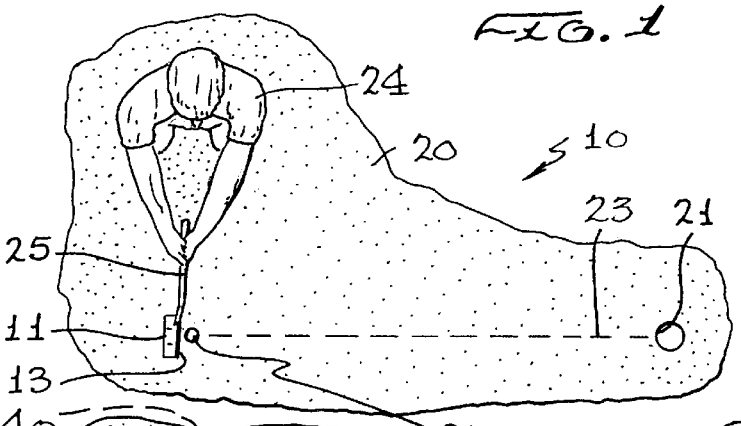
FIG. 1 is a diagrammatic plan view illustrating a golfer in position to strike a golf ball so as to follow an intended path towards a target utilizing the inventive golf head of the present invention.

Referring to FIG. 1, a putting green is illustrated by numeral 20 which includes a hole or cup 21 serving as a target into which a golf ball 22 is intended to reach by travelling along a path 23. A golfer 24 addresses the ball preparatory to striking the ball and holds a club 25 in close proximity to the ball 22 so that upon a swing or stroke, the club head 11 will strike or impact the ball 22. In order to achieve advancement of the ball along the path 23, the golfer aligns the face 13 of the club with the back side of ball 22. A feature of the present invention is to provide sighting or guide means interiorly of the head 11 and embed the sighting or guide means in a transparent material so that the golfer may align the face 13 with the ball 22 employing the sighting arrangement of the club 11.

Figure 2:
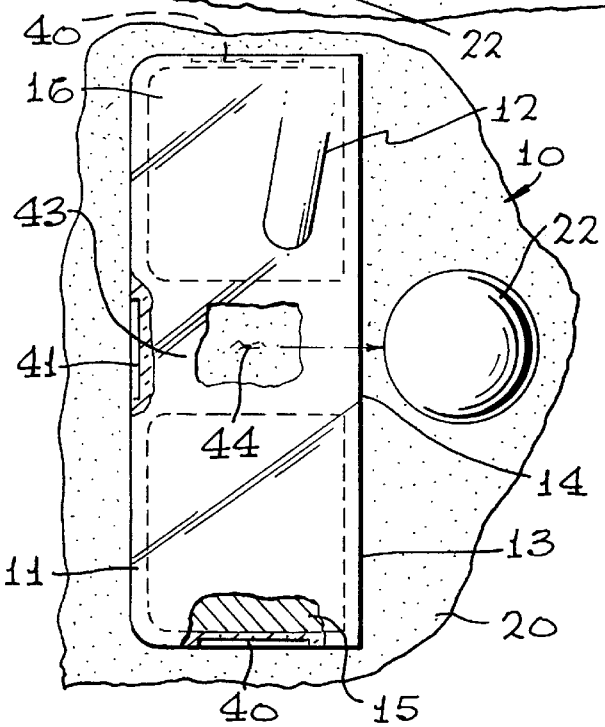
FIG. 2 is a top plan view, partly in section, of a golf club head incorporating the alignment, sighting and counterweight means of the present invention.

Referring to FIG. 2, the novel golf club head incorporating the present invention is broadly indicated in the direction of arrow 10 wherein the head 11 is carried on the end of a club shaft 12. The head 11 is composed of a transparent or at least a translucent plastic material and includes a forward face 13 having a ball impacting surface 14 which is intended to impinge against a golf ball. The ball engaging surface 14 may be of any suitable nature and may be clear so as to permit visual observation therethrough. The surface may take the form of a mesh material or a grid but is preferably smooth and flat. The head 11 includes opposite sides, a top and bottom which are also characterized as light-transmitting so that the interior of the head can be observed by the golfer preparatory to a swing or stroke as well as the ground or grass beneath. Only front surface 14 provides a striking surface. The opposite sides as well as the back side include a recess such as recess 40 on each side and recess 41 on the back. The presence of the recesses eliminates the opposite sides and the back side as ball hitting or striking surfaces.

Embedded or incorporated within the material of the head 11, there is a sighting, aligning or guide means provided that may take the form of a pair of blocks or rods 15 and 16 which are arranged in fixed parallel spaced-apart relationship separated by a visually clear midsection 43. The alignment or guide means 15 and 16 are visually accessible to the golfer as he aligns the face 13 and impact surface 14 with the golf ball so that when impacted, the ball will follow an intended path to a target. Of import is the opportunity for the golfer to look through the midsection 43 to observe the turf or gound beneath the head and to concentrate on a sighting aid such as a blade of grass 44 or the like.

Figure 3:
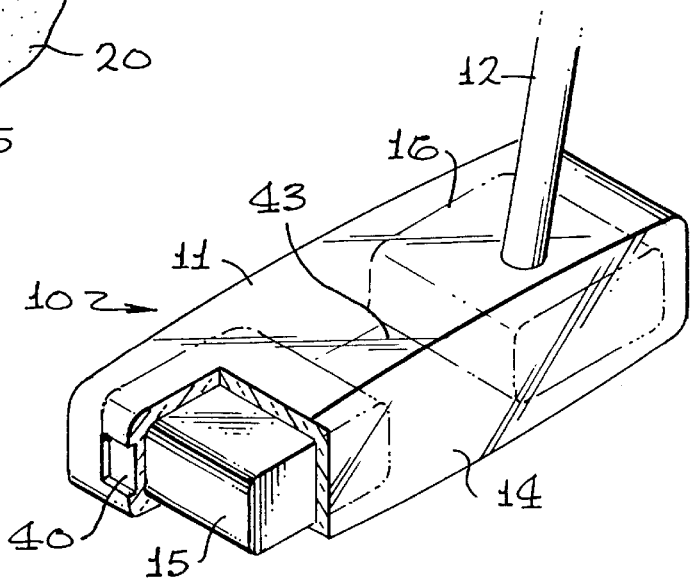
FIG. 3 is an enlarged front perspective view, partially in section, of the golf head used on the golf club shown in FIG. 1.

FIG. 3 illustrates the inventive golf club head 10 wherein it can be seen that the composition of the head is of a transparent or translucent material and that the sighting, alignment or guide means includes the weighted blocks 15 and 16 which are arranged in fixed parallel spaced-apart relationship on either side of midsection 43. The opposite ends of each of the blocks 15 and 16 are flat and are in alignment with one another which provides that the flat ends be substantially parallel with the front face 13. The parallel relationship of the ends as well as the central longitudinal axes of the blocks or rods serve as visual aids for the golfer 24 to align the flat face 13 with the ball 22 so that the ball will follow an intended path 23 to the target 21. Preferably, the two blocks 15 and 16 are embedments within the translucent or transparent material of the head and may be made of brass or copper so that they are non-transparent and readily visible to the golfer. The weighted blocks may carry a sandblasted surface to produce a non-glare surface. Rods may be used instead of blocks and may be approximately three-eighths inch diameter and the rod ends are perpendicular to the face 13 of the head 11. The blocks or rods are employed as an alignment feature as well as counterweights to balance the club head so as to prevent twisting during the swing or stroke of the golfer. By employing translucent or transparent material for the club head, a see-through construction is provided so that the golfer may use ancillary guiding or sighting means to align the club head striking surface or face 13 with the ball. Some such ancillary means may take the form of grass blade 44 under the club head or possibly a spot on the ground or green.

The size and shape of the club head is unimportant; however, the ability to see and view through the club head so that the two aiming blocks or rods embedded in the middle of the club head are available for aiming at a spot directly beneath the head. This arrangement greatly enhances the accuracy and predictability of the golf shot.

Figure 4A:
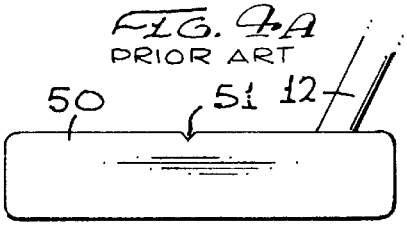
FIG. 4A PRIOR ART

FIG. 4A illustrates a conventional golf putter head 50 with a sighting groove 51 available to the sight of the golfer. However, the groove does not relate the golfer's eye with any particular target or area immediately behind the golf ball 22 since the backward swing of the club removes the sighting groove from the golfer's eye and from the golf ball resting area. Additionally, the head 50 is solid and opaque which prevents observation of the ground or grass beneath the head 50.

Figure 4B:
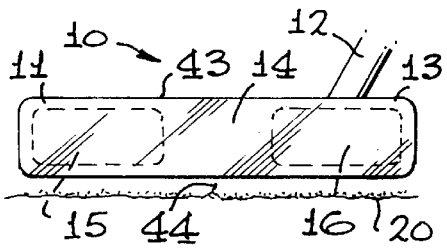

FIG. 4B, in comparison, illustrates that the midsection 43 of the head 11 between the blocks 15 and 16 is translucent or transparent so that the ground or grass 20 is visually available to the golfer. The golfer can select a blade 44 and align his club head swing so that the head passes over the blade with the blocks 15 and 16 on either side with the ball also being in linear alignment with the ball. Midsection 43 is broken away in FIG. 2 to reveal the blade 44 The golfer can focus on a spot on the green or a blade of grass directly behind the ball which allows the golfer to maintain his eyes focused on this spot through the entire stroke while eliminating the natural reflex for head movement to watch the putter head motion.

Figure 5:
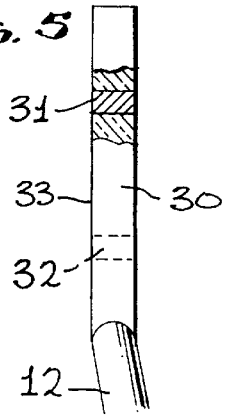
FIG. 5 is a top plan of another version of the invention.

FIG. 5 illustrates another embodiment of the invention wherein the shape and size of the club head is different from that which is shown in FIG. 3. This different shape emphasizes the point that size and shape does not dictate the aiming characteristics of the invention. The embodiment shown in FIG. 5 may be used by a right-handed or a left-handed golfer and includes a head 30 composed of translucent or transparent material in which the rods 31 and 32 are disposed in fixed parallel spaced-apart relationship and wherein the front and rear ends of the rods are parallel with respect to the striking face 33 of the head. As described with respect to the embodiment shown in FIG. 3, the rods 31 and 32 also serve as counterweights and are of a solid material which is readily visible through the translucent or transparent material of the club 30.

In one form of the invention, head 10 has combined the use of 100% solid brass inserts, whether blocks or rods, suspended in a clear acrylic. The acrylic serves as a visually pleasing structural material used to suspend and expose the brass inserts inside the club head while providing the golfer with exceptional feel and control. The putter features a cambered sole or bottom surface and a leading edge radius to significantly reduce drag and accommodate ball address on uneven greens. The brass inserts provide three performance benefits, a high moment of inertia or resistance to twisting, which is a result of more than 88 percent of the club head weight being distributed toward the heel and toe of the club head; faultless face balance, to encourage a straight-back and straight-through stroke; and the parallel positioning of the inserts facilitate the accurate and precise alignment of the putter head along the intended line of the stroke.

In summary, the putter body is made from a plastic material, an acrylic blend, very well suited to striking a golf ball. This material has a transparency equal to glass, good weatherability and high impact resistance. It is also very lightweight which allows movement about 90% of the total head weight to the toe and heel, enabling the head to tract more on line through the stroke. The two brass weights are perpendicular to the face and parallel to each other allowing the golfer the opportunity to look through the clear head and see nothing but the green target and two parallel pieces of brass pointing down or along a line of intended ball travel. Because the eyes provide the golfer such powerful feedback information, the eyes are kept busy along with the conscious mind during the putting stroke. The best way to achieve this is to make the head clear or transparent so the golfer can line-up the putter with the ball, look through the head to spot a blade of grass as a target or any mark on the green beneath the head and, most importantly, keep that target or mark in his conscious focus throughout the entire stroke. This achieves two things for the golfer. First, it will keep the golfer's head still and avoid the tendency of head or eye movement following the head travel or swing. Most important, it requires maximum mental discipline to keep the target or spot in focus throughout the stroke so as to not allow the golfer an opportunity to think about mechanics.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A golf club head comprising an elongated head composed of a translucent or transparent material;

weighted material embedded in said head;

a viewing area provided in said translucent or transparent material adjacent to said weighted material;

golf club shaft secured to said head for swinging said head during the course of play;

said weighted material includes a pair of blocks separated by said viewing area;

said head includes a top surface and a bottom surface;

said viewing area providing player observation through said top surface and said bottom surface;

said head has opposite sides; and each of said opposite sides having surface means rendering said opposite sides irregular and unsuitable for ball striking purposes.

2. An elongated head having a front ball striking surface, a back surface and opposite side surfaces extending between said front ball striking surface and said back surface;

a see-through window provided in said elongated head between said opposite sides enabling a player to view through said see-through window;

weight means carried on said head adjacent to said see-through window;

said head is composed of a translucent or transparent material;

said weight means includes a pair of weighted members embedded in said translucent or transparent material separated by said see-through window; and said opposite side surfaces include shallow recesses providing irregular and suitable non-ball striking surfaces while said front ball striking surface remains the sole and only suitable ball striking surface.

3. The golf putter head defined in claim 2 wherein:

said see-through window enables a player to view through said see-through window to focus on a target separated from and beneath said see-through window allowing maximum visual concentration throughout a golf stroke or swing on said target without an opportunity to mentally dwell on stroke mechanics.

4. The golf putter head defined in claim 2 wherein:

said weighted members are chosen from:

a. solid metal blocks b. solid metal rods.

5. The golf putter head defined in claim 4 wherein:

said weighted members combine to provide 70% to 90% of the total weight of said head.

6. The golf putter head defined in claim 5 wherein:

said head includes a curved top surface and a cambered bottom surface for providing an aerodynamic shape; and said see-through window occupying a midsection of said head between said weighted members allowing the player to view the grass or ground beneath said head via said top surface and said cambered bottom surface.

7. The golf putter head defined in claim 6 wherein:

said weighted members include roughened exterior surfaces constituting anti-glare characteristics.

8. The golf club head defined in claim 7 wherein:

said head employs surface treatment to obtain a desired degree of reflectivity or transmissivity of incident light.

9. The golf club head defined in claim 8 wherein:

said weighted members provide an alignment means for placement of said front ball striking surface behind a golf ball and for providing a counterweight means to achieve balance to avoid twisting of said head when swung by the golfer.

* * * * *